US010180140B2

(12) United States Patent
Hauser et al.

(10) Patent No.: US 10,180,140 B2
(45) Date of Patent: Jan. 15, 2019

(54) PULSATION DAMPER FOR COMPRESSORS

(71) Applicant: Ingersoll-Rand Company, Davidson, NC (US)

(72) Inventors: Jan Hauser, Dortmund (DE); Philipp Schulze-Beckinghausen, Oberhausen (DE); Sven Herlemann, Datteln (DE); Michael Beinert, Dortmund (DE); Frank Banaszak, Recklinghausen (DE); Daniel Kistner, Muenster (DE)

(73) Assignee: Ingersoll-Rand Company, Davidson, NC (US)

( * ) Notice: Subject to any disclaimer, the term of this patent is extended or adjusted under 35 U.S.C. 154(b) by 0 days.

(21) Appl. No.: 15/282,149

(22) Filed: Sep. 30, 2016

(65) Prior Publication Data

US 2018/0094629 A1 Apr. 5, 2018

(51) Int. Cl.

| | |
|---|---|
| ***F04C 29/06*** | (2006.01) |
| ***F04C 29/00*** | (2006.01) |
| ***F04C 18/16*** | (2006.01) |
| ***G10K 11/16*** | (2006.01) |
| ***F04B 39/00*** | (2006.01) |
| ***F04D 29/66*** | (2006.01) |

(52) U.S. Cl.

CPC ..... *F04C 29/0035* (2013.01); *F04B 39/0027* (2013.01); *F04B 39/0055* (2013.01); *F04B 39/0061* (2013.01); *F04C 18/16* (2013.01); *F04C 29/06* (2013.01); *F04D 29/665* (2013.01); *G10K 11/161* (2013.01); *F05D 2250/52* (2013.01)

(58) Field of Classification Search

CPC ..... F04C 29/0035; F04C 18/16; G10K 11/161

USPC ..... 181/200, 229

See application file for complete search history.

(56) References Cited

U.S. PATENT DOCUMENTS

| | | | | |
|---|---|---|---|---|
| 2,990,907 | A | 7/1961 | Everett | |
| 4,050,539 | A | 9/1977 | Kashiwara et al. | |
| 4,109,751 | A * | 8/1978 | Kabele | F01N 1/089 181/229 |
| 4,420,063 | A * | 12/1983 | Bohlmann | F01N 1/003 181/229 |
| 5,647,314 | A * | 7/1997 | Matsumura | F02M 35/1255 123/184.57 |
| 6,220,839 | B1 | 4/2001 | Sheridan et al. | |
| 6,422,842 | B2 | 7/2002 | Sheridan et al. | |
| 7,549,509 | B2 | 6/2009 | Lucas et al. | |
| 8,142,172 | B2 * | 3/2012 | Forster | F04C 29/061 181/403 |
| 9,062,679 | B2 | 6/2015 | Lucas et al. | |
| 9,551,342 | B2 * | 1/2017 | Huang | F04C 29/065 |

(Continued)

FOREIGN PATENT DOCUMENTS

| | | |
|---|---|---|
| CN | 1280251 A | 1/2001 |
| CN | 1542284 A | 11/2004 |

(Continued)

OTHER PUBLICATIONS

European Search Report; Application No. 171891 70.8-1004; dated Feb. 5, 2018.

*Primary Examiner* — Forrest M Phillips

(74) *Attorney, Agent, or Firm* — Jones IP Group; Wayne A. Jones

(57) ABSTRACT

Devices, systems, and methods for pulsation dampers for compressors include outer and inner chambers forming parallel flow paths.

24 Claims, 8 Drawing Sheets

(56) References Cited

U.S. PATENT DOCUMENTS

| | | | | |
|---|---|---|---|---|
| 9,739,290 | B2 * | 8/2017 | Lucas | F04D 29/668 |
| 2001/0002980 | A1 | 6/2001 | Sheridan et al. | |
| 2004/0187828 | A1 * | 9/2004 | Yasuda | F02M 35/10019 123/184.57 |
| 2006/0056987 | A1 | 3/2006 | Seok et al. | |
| 2006/0124385 | A1 | 6/2006 | Lucas et al. | |
| 2006/0237081 | A1 | 10/2006 | Lucas et al. | |
| 2008/0145242 | A1 | 6/2008 | Seibel et al. | |
| 2009/0218164 | A1 | 9/2009 | Lucas et al. | |
| 2010/0209280 | A1 | 8/2010 | Flannigan et al. | |
| 2012/0171069 | A1 | 7/2012 | Huang et al. | |
| 2014/0251719 | A1 * | 9/2014 | Feld | F02M 35/1272 181/229 |
| 2015/0198149 | A1 * | 7/2015 | Lucas | F04B 11/0091 417/53 |
| 2015/0198179 | A1 * | 7/2015 | Lucas | F04D 29/668 137/14 |
| 2015/0337841 | A1 * | 11/2015 | Huang | F04C 29/065 418/55.1 |
| 2015/0361982 | A1 | 12/2015 | Huang et al. | |

FOREIGN PATENT DOCUMENTS

| | | | |
|---|---|---|---|
| CN | 1183326 | C | 1/2005 |
| CN | 1749572 | A | 3/2006 |
| CN | 100408861 | C | 3/2006 |
| CN | 101105177 | A | 1/2008 |
| CN | 101398005 | A | 4/2009 |
| CN | 101809251 | A | 8/2010 |
| CN | 101806251 | B | 8/2012 |
| CN | 104454548 | A | 3/2015 |
| CN | 105090671 | A | 11/2015 |
| CN | 105114284 | A | 12/2015 |
| DE | 197 37 799 | A1 | 4/1998 |
| EP | 1067289 | A2 | 1/2001 |
| EP | 1715188 | A1 | 10/2006 |
| EP | 1715189 | A1 | 10/2006 |
| EP | 1715238 | A2 | 10/2006 |
| EP | 1876358 | A1 | 1/2008 |
| EP | 2198125 | A1 | 6/2010 |
| JP | 2006300070 | A | 11/2006 |
| JP | 4976046 | B2 | 4/2012 |
| WO | WO 2005/008069 | A1 | 1/2005 |
| WO | 2009/045187 | A1 | 4/2009 |
| WO | 2015109149 | A2 | 7/2015 |

* cited by examiner

PULSATION DAMPER FOR COMPRESSORS

TECHNICAL FIELD

The present disclosure relates, generally, to dampers and, more particularly, to dampers for gas compressors.

BACKGROUND

Compressors, for example, gas compressors can produce noise, vibration, pulsation, and/or other incidental forces and/or effects. Different types of compressors may be particularly prone to certain incidental forces and/or effects. Reducing such incidental forces and/or effects can increase operational life and reliability, and can reduce maintenance requirements.

SUMMARY

According to one aspect of the present disclosure, a damper for reducing pulsation from a compressor may include an outer chamber defining an outer cavity therein, the outer chamber being arranged to pass flow from an inlet to an outlet thereof, an inner chamber arranged within the outer cavity and defining an inner cavity therein, the inner chamber being arranged to pass flow from an inlet to an outlet thereof. The damper may include a number of partitions dividing the outer chamber into sections, the number of partitions each extending between the outer chamber and the inner chamber.

In some embodiments, the sections of the outer chamber may each be connected with each other near the inlet of the inner chamber to form an inlet manifold and are connected with each other near the outlet of the inner chamber to form an outlet manifold. In some embodiments, the sections of the outer chamber may each extend between the respective inlet and outlet manifolds and define parallel flow paths. In some embodiments, the inlet of the inner chamber may be connected with the inlet manifold and the outlet of the inner chamber may be connected with the outlet manifold.

In some embodiments, a housing may form at least a portion of the outer chamber, the housing including a body and a cap fastened to the body to define at least a portion of the outer cavity. In some embodiments, the body may form a base portion of the outer chamber and may form the inner chamber. In some embodiments, the cap may form a head portion of the outer chamber. In some embodiments, the body may form a base portion of each of the number of partitions.

In some embodiments, the cap may form a head portion of each of the number of partitions. In some embodiments, each base portion may include a fastener hole defined therethrough for receiving a fastener to secure the body with the compressor. In some embodiments, the head portion of each of the number of partitions may be arranged to prevent removal of the fastener from the fastener hole of the corresponding base portion.

In some embodiments, the damper may include a damper plate arranged between the base portion and the head portion of each of the number of partitions. In some embodiments, the damper plate may be a perforated plate arranged to span across the outlet of the inner chamber to receive at least a portion of flow therethrough.

In some embodiments, the damper plate may be attached to the head portion of the number of partitions. In some embodiments, the damper plate may be attached to the head portion with at least one fastener and at least one of the inner chamber and the base portions of the number of partitions may be arranged to prevent removal of the at least one fastener when the cap is fastened to the body.

According to another aspect of the disclosure, a damper for reducing pulsation from a compressor may include an outer chamber defining an outer cavity therein, the outer chamber being arranged to pass flow from an inlet to an outlet thereof, an inner chamber arranged within the outer cavity and defining an inner cavity therein, the inner chamber being arranged to pass flow from an inlet to an outlet thereof, and a number of partitions dividing the outer chamber into sections that are each connected with the inlet and outlet of the outer chamber to form parallel flow paths. The inlet of the inner chamber may include a number of inlet openings defined through an inlet wall of the inner chamber.

In some embodiments, the inlet wall may have a conical shape that is convex on an outer side thereof to guide at least some flow through the sections.

In some embodiments, a first flow passage may be defined from the inlet of the outer chamber, through at least one of the ections, to the outlet of the outer chamber. A second flow passage may be defined from the inlet of the inner chamber, through the inner chamber, and through the outlet of the inner chamber. The first flow passage and the second flow passage may be arranged in parallel with each other.

In some embodiments, the damper may include a perforated plate arranged near the outlet of the inner chamber. In some embodiments, the second flow passage may be further defined through the perforated plate.

According to another aspect of the present disclosure, a damper for reducing pulsation from a compressor may include an outer chamber defining an outer cavity therein, the outer chamber being arranged to pass flow from an inlet to an outlet thereof, an inner chamber arranged within the outer cavity and defining an inner cavity therein, the inner chamber being arranged to pass flow from an inlet to an outlet thereof, and a number of partitions dividing the outer chamber into sections that are each connected with the inlet and outlet of the outer chamber to form parallel flow paths. A housing may form at least a portion of the outer chamber. The housing may include a body and a cap attached to the body to define at least a portion of the outer cavity.

In some embodiments, the housing may include a base having an intake passage defined therethrough. In some embodiments, the intake passage may be connected with the inlet of the outer chamber to receive flow from the compressor. In some embodiments, the intake passage may form an intake nozzle. In some embodiments, the base may be integrally formed with the body.

In some embodiments, the sections may be connected to each other to form an outlet manifold and the outlet of the outer chamber is arranged within only one of the sections.

In some embodiments, the housing may include a discharge limb extending from the outer chamber and defining a discharge passage that extends from the outlet of the outer chamber through the discharge limb to expel flow.

According to another aspect of the present disclosure, a damper system for reducing pulsation from a compressor may include a first stage damper, and a second stage damper. The first and second stages dampers may each include an outer chamber defining an outer cavity therein, the outer chamber being arranged to pass flow from an inlet to an outlet thereof, and an inner chamber arranged within the outer cavity and defining an inner cavity therein, the inner chamber being arranged to pass flow from an inlet to an outlet thereof. In some embodiments, at least one of the first and second stage dampers may include a number of partitions dividing the respective outer chamber into sections that are each connected with the inlet and the outlet of the outer chamber to form parallel flow paths.

In some embodiments, the first stage damper may be attached to the compressor to receive partially compressed air, pass the partially compressed air from the inlet to the outlet of the outlet chamber thereof, and to discharge the partially compressed into the compressor for further compression, and wherein the second stage damper is attached to the compressor to receive fully compressed air, pass the fully compressed air from the inlet to the outlet of the outlet chamber thereof and to discharge the fully compressed air for use.

Additional and/or different features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE DRAWINGS

Figure 1:
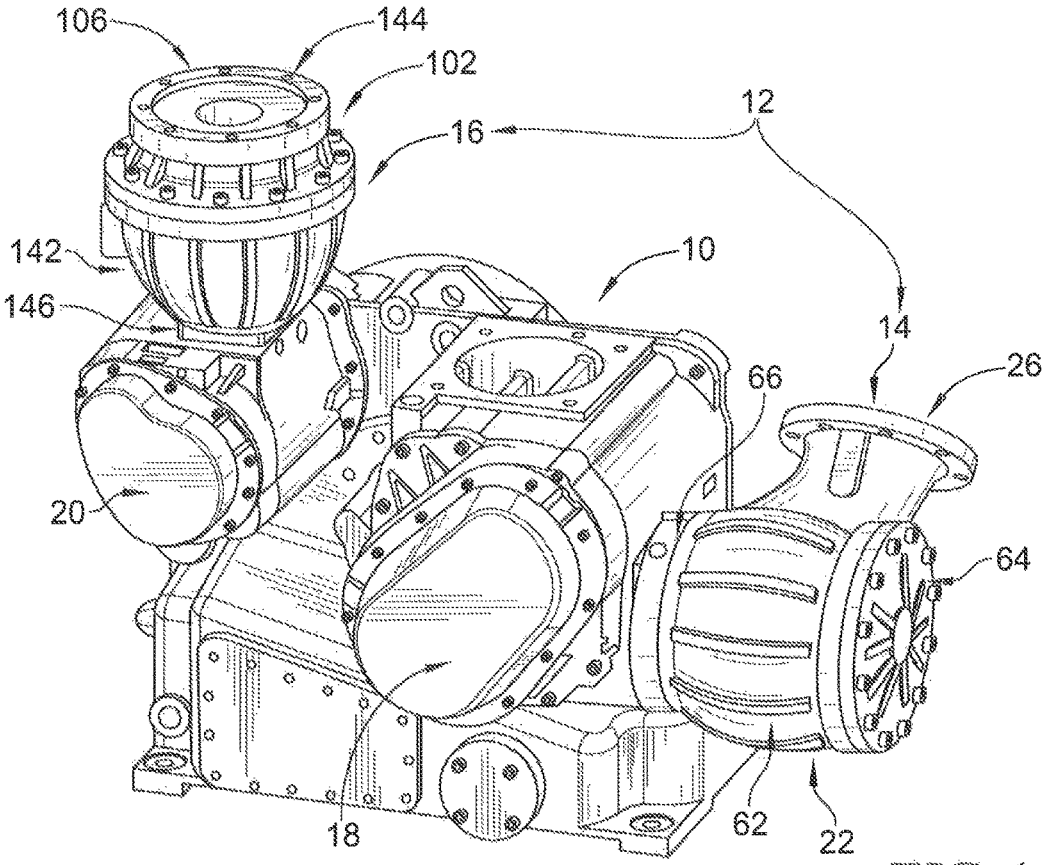
FIG. 1 is a perspective view of a compressor assembly including a damper assembly having a first stage damper (left) and a second stage damper (right) secured to the compressor.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

In the illustrative embodiment as shown in FIG. 1, a compressor assembly includes a compressor 10 having a damper system 12 for reducing pressure pulsations. The damper system 12 illustratively includes a first stage damper 14 and a second stage damper 16 each secured to the compressor 10. The compressor 10 is illustratively embodiment as a displacement-type gas compressor, namely a screw compressor, but in some embodiments may include any fluid compressor. The compressor 10 illustratively includes two compression stages 18, 20, but in some embodiments may include any suitable number of compression stages.

The compressor 10 illustratively compresses a fluid (illustratively gas) in a first compression stage 18 to an initial pressure (partially compressed). The first stage damper 14 illustratively receives a flow of partially compressed fluid from the first compression stage 18, dampens and discharges the flow. In the illustrative embodiment, the flow discharged from the first stage damper (still partially compressed) reenters the compressor 10 for further compression in a second compression stage 20. In some embodiments, at least one portion of the flow discharged from the first stage damper 14 may be cooled by at least one cooler (interstage cooler) before reentering the compressor 10, and/or may be distributed for use at the initial pressure.

The compressor 10 illustratively compresses the flow of partially compressed fluid (discharged from the first stage damper 14) in a second compression stage 20 to a final pressure (fully compressed). The second stage damper 16 illustratively receives a flow of fully compressed fluid from the second compression stage 20, dampens and discharges the flow. In the illustrative embodiment, the flow discharged from the second stage damper 16 (fully compressed) is discharged for use at the final pressure. In some embodiments, the flow discharged from the second stage damper may be further conditioned, for example but without limitation, dehumidified according to final design requirements.

As mentioned above, the compressor 10 is embodied as a displacement-type compressor. The compression stages 18, 20 are illustratively embodied as screw compression stages. Displacement compression can naturally result in incidental forces, for example but without limitation, pressure pulsations, due to the mechanics of operation. Pressure pulsations illustratively include naturally imposed pressure fluctuations (e.g., peaks and valleys) resultant from the cyclic nature of certain compression mechanics. Stresses on the compressor and/or related equipment can be reduced by damping (calming) the pressure fluctuations effectively. Effectively reducing the pressure pulsations can increase operational life, increase reliability, and/or reduce maintenance requirements.

Figure 2:
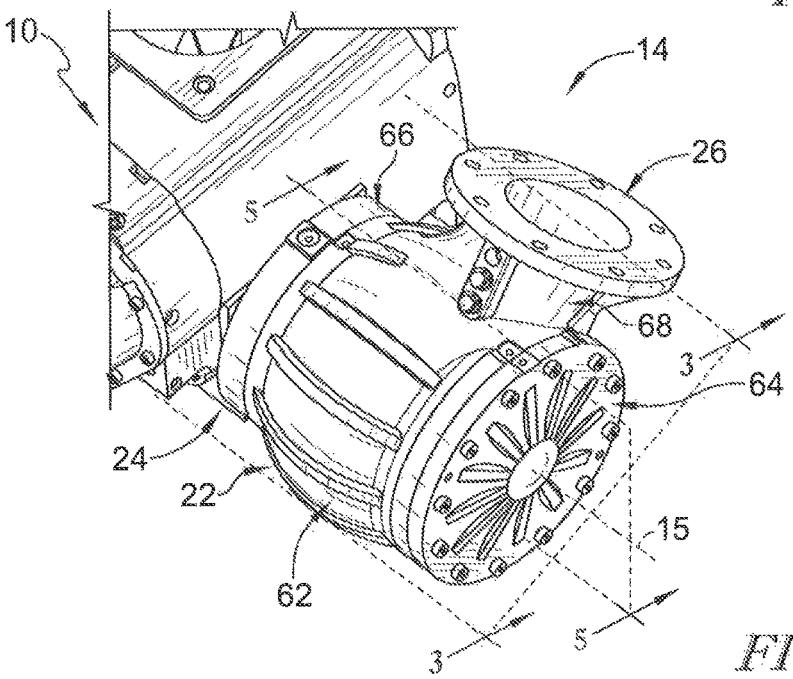
FIG. 2 is a closer perspective view of the first stage damper showing that the first stage damper includes an intake (left) connected to the compressor to received partially compressed air and a discharge (shown disconnected) for discharging partially compressed air having been dampened by the first stage damper.

In the illustrative embodiment as shown in FIG. 2, the first stage damper 14 illustratively includes a housing 22 that forms an intake 24 and a discharge 26. The intake 24 is illustratively connected to the compressor 10 to receive a flow of partially compressed fluid. The flow of partially compressed fluid passes through the housing 22 for dampening and exits through the discharge 26. As mentioned above, the flow from the discharge 26 illustratively returns to the compressor 10 for further pressurization. Auxiliary components, such as piping components, returning, the flow to the compressor 10 from the discharge 26, are implied but not shown to reveal detail.

Figure 3:
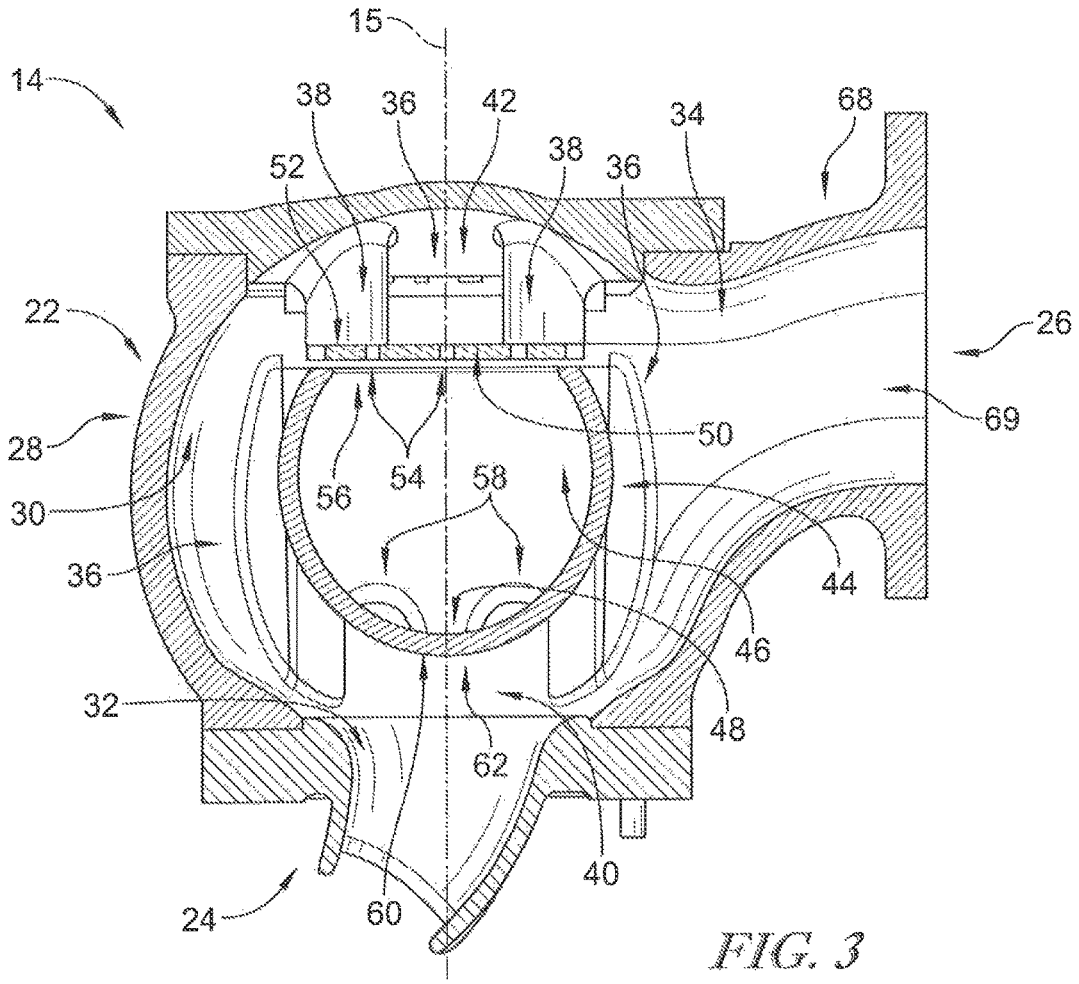
FIG. 3 is a cross-sectional view of the first stage damper of FIGS. 1 and 2, taken along the line 3-3 in FIG. 2 showing that the first stage damper includes an outer chamber, an inner chamber arranged within the outer chamber, and partitions that divide the outer chamber into sections that create parallel flow paths between the intake and the discharge, and showing that the damper includes a perforated damper plate arranged beyond an outlet of the inner chamber.

As shown in FIG. 3, the first stage damper 14 illustratively includes an outer chamber 28 formed at least partially by the housing 22. The outer chamber 28 illustratively includes an outer cavity 30 defined therein. In the illustrative embodiment, the outer chamber 28 and the outer cavity 30 are each generally spherical and are generally symmetrical about a central axis 15. The outer chamber 28 illustratively includes an inlet 32 and an outlet 34 each defined as openings of the outer chamber 28 that connect with the outer cavity 30. Partitions 38 (discussed below in more detail) illustratively divide the outer chamber 28 into sections 36. The sections 36 illustratively connect with each other at opposite ends to from manifolds 40, 42 which connect the outer chamber 28 with an inner chamber 44.

As shown in FIG. 3, the inner chamber 44 is illustratively arranged within the outer cavity 30 of the outer chamber 28. The inner chamber 44 illustratively includes an inner cavity 46 defined therein. In the illustrative embodiment, the inner chamber 44 and the inner cavity are generally spherical and are generally symmetrical about the central axis 15. The inner chamber 44 illustratively includes an inlet 48 and an outlet 50 each embodied as openings of the inner chamber 44 that connect with the inner cavity 46. In the illustrative embodiment, the inlet 48 and outlet 50 are arranged at opposite axial ends of the inner chamber 44 and connect with the manifolds 40, 42.

A damper plate 52 is illustratively arranged within the manifold 42 near the outlet of the inner chamber 44 as shown in FIG. 3. The damper plate 52 illustratively includes perforations 54 extending therethrough parallel to the axis 15. In the illustrative embodiment, the damper plate 52 is arranged spaced apart from the inner chamber 44 to define a clearance 56 therebetween. In the illustrative embodiment, portions of flow that pass through the inner chamber 44 and exit through the outlet 50 illustratively form an inner flow, and can either pass through the perforations 54 or the clearance 56 into the manifold 42. Portions of flow that pass from the inlet 32 through the sections 36 of the outer chamber 28 illustratively form an outer flow.

As shown in FIG. 3, the inlet 48 of the inner chamber 44 illustratively connects with the manifold 40. The inlet 48 illustratively includes four openings 58 (two of which are shown in the cross-sectional view of FIG. 3) extending through a wall 60 of the inner chamber 44. The wall 60 at the inlet 48 illustratively has a generally convex shape on an outer side 62 that faces the manifold 40 and the inlet 32 of the outer chamber 28 to guide at least a portion of the incoming flow from the inlet 32 towards the sections 36.

As shown in FIG. 3, the openings 58 of the inlet 48 illustratively penetrate through the wall 60 and connect the manifold 40 with the inner cavity 46. In the illustrative embodiment, the openings 58 are distributed evenly about the axis 15 and extend through the wall 60 in a direction that is generally parallel to the axis 15 and complimentary to the major direction of flow through the inlet 32 of the outer chamber. The inlet 48 illustratively form a flow divider guiding a portion of flow through its openings 58 (and out through its outlet 50) and another portion of flow into the sections 36. The different portions of flow illustratively pass through the first stage damper 14 in parallel with each other between the intake 24 and the discharge 26.

As shown in FIG. 3, the partitions 38 illustratively extend between the outer chamber 28 and the inner chamber 44 to define the sections 36 of the outer chamber 28. The partitions 38 illustratively extend axially through the outer cavity 30. In the illustrative embodiment, the partitions 38 are embodied as walls distributed evenly about the axis 15 and provide structural support to the housing 22 while separating the outer chamber 28 into the sections 36. The sections 36 illustratively form distinct flow paths arranged in parallel with each other and connecting with each other to form the manifolds 40, 42. The inner chamber 44, in combination with the damper plate 52, illustratively dissipate pressure pulsations from the compressor 10. The distinct flow paths provided by the sections 36 illustratively assist in reducing pressure pulsations within the total flow from the compressor 10.

Figure 4:
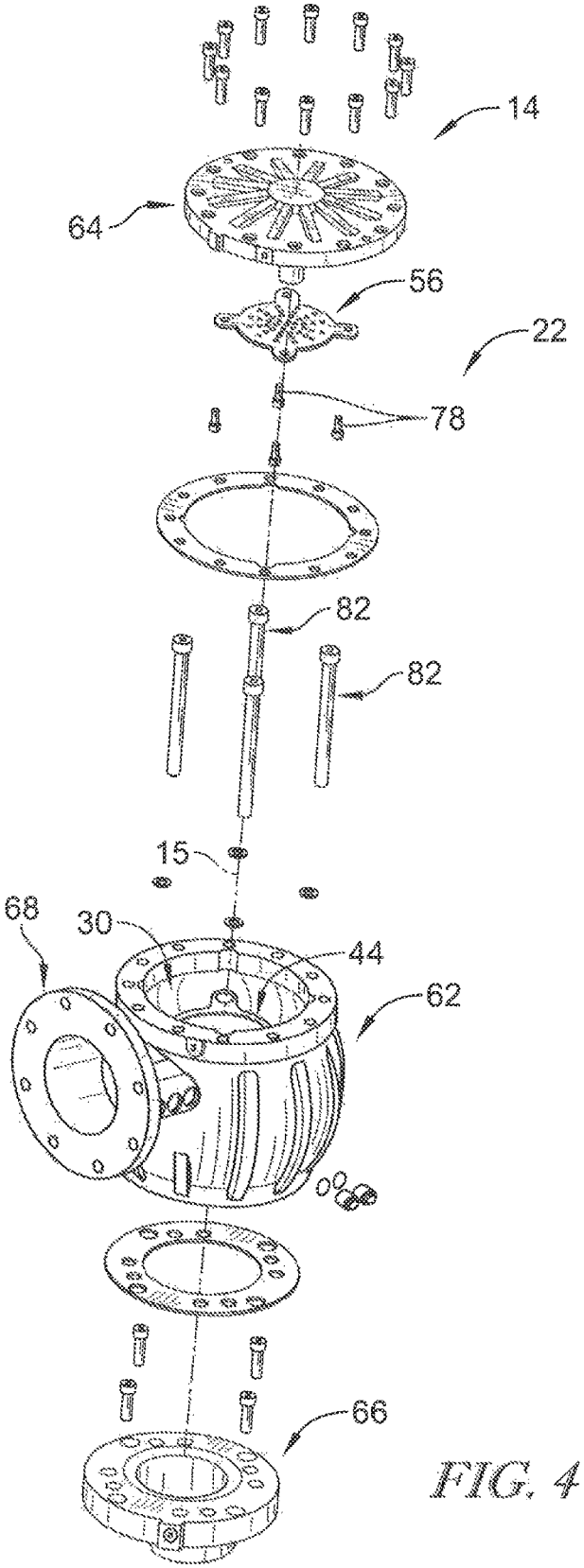
FIG. 4 is an exploded perspective view of the first stage damper of FIGS. 1-3 showing that the first stage damper includes a housing that forms a portion of the outer chamber and showing that the housing includes a body, a cap, and a base.

As shown in FIG. 4, the housing 22 illustratively includes a body 62, a cap 64, and a base 66 that collectively compose the outer chamber 28. The cap 64 and the base illustratively attach to the body 62 at opposite ends to enclose the outer chamber 28. The discharge 26 illustratively includes a discharge limb 68 that extends from the body 62 and defines a discharge passage 69 extending therethrough and connecting with the outlet 34 of the outer chamber 28. In the illustrative embodiment, the discharge limb 68 extends from the body 62 radially away from the axis 15. The discharge passage 69 is illustratively directly connected with only a single section 36 of the outer chamber 28 and communicates with the manifold 42 (and the other section 36) through the single section 36.

Figure 5:
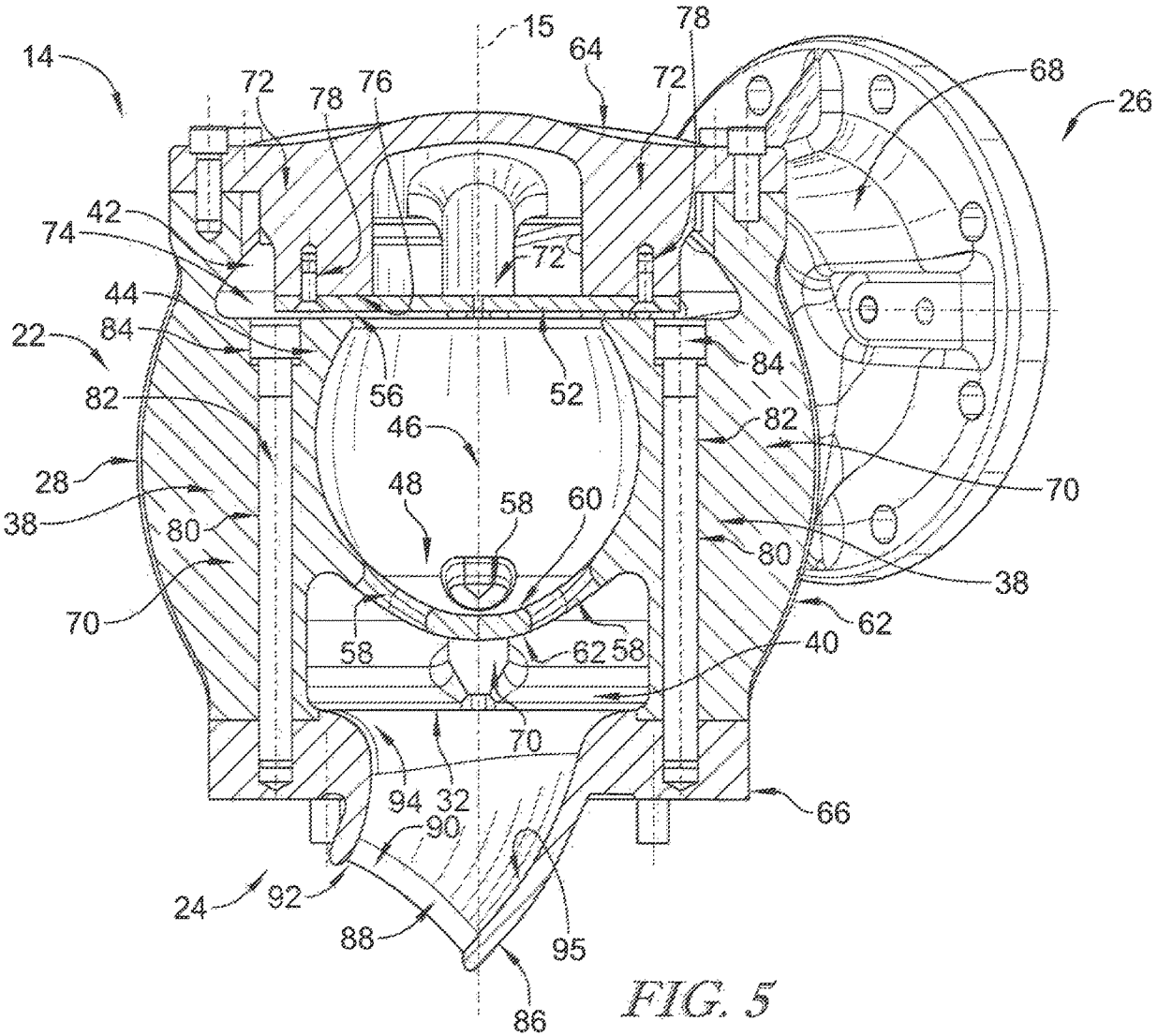
FIG. 5 is a cross-sectional view of the first stage damper of FIGS. 1-4, taken along the line 5-5 in FIG. 2 showing that the partitions extend between the outer chamber and the inner chamber and include holes for receiving long bolts which are prevented from being removed from their holes by the cap, and showing that the housing includes a base secured to the body by the long bolts.

As best seen in FIG. 5, the partitions 38 each include a base portion 70 and a head portion 72. Each base portion 70 illustratively extends between the outer chamber 28 and the inner chamber 44 and includes an axial end 74 arranged near the manifold 42. In the illustrative embodiment, each base portion 70 is illustratively formed integrally with each of the inner and outer chambers 28, 44, but in some embodiments, may be formed separately or integrally with only one of the chambers 28, 44. Each head portion 72 illustratively extends from the cap 64 into the outer chamber 28 to an inner end 76 opposite the axial end 74 of the base portion 70.

As shown in FIG. 5, the damper plate 52 is illustratively arranged between the base portion 70 and the head portion 72 of each partition 38 to define the clearance 56 with the inner chamber 44. The damper plate 52 is illustratively attached to each head portion 72 by fasteners 78 that extend through the damper plate 52 and connect with the respective head portions 72. In the illustrative embodiment, the fasteners 78 are bolts having outer threads for engagement with complimentary inner threads of the head portions 72.

As shown in FIG. 5, the base portion 70 of each partition 38 illustratively includes a fastener hole 80 extending axially therethrough from the axial end 74 towards the base 66. The fastener holes 80 are illustratively arranged to receive fasteners 82 therethrough to connect with the base 66 for securing the base 66 to the body 62. Each fastener 82 illustratively includes a head 84 that is recessed within a larger portion of the fastener hole 80. In the illustrative embodiment, the fasteners 82 are bolts having external threads for engagement with complimentary internal threads of the base 66.

As shown in FIG. 5, the fasteners 78, 82 are illustratively prevented from removal from their secured positions by the arrangement of the base and head portions 70, 72 of the partitions 38 and/or the inner chamber 44. As shown in FIG. 5, the head portion 72 of the partitions 38 is arranged in close proximity to the fasteners 82 and their fastener holes 80 and if any fastener 82 (or any portion thereof, for example, broken fragment) began to exit its fastener hole 80 within the base portion 70, the fastener 82 would contact the respective head portion 72 and be prevented from entering into the flow paths within the first stage damper 14 (and downstream). As shown in FIG. 5, the base portion 70 of each partition 38 and/or the inner chamber 44 are arranged in close proximity to the fasteners 78 and if any fastener 78 began to exit connection with the head portion 72, the fastener 78 would contact the respective base portion 70 and/or the inner chamber 44 and be prevented from entering into the flow paths within the first stage damper 14 (and downstream). Such interference arrangement of the fasteners 78, 82 can prevent accidental entrainment of fasteners into the flow paths of the dampers 14, 16 (and into the compressor 10) while the dampers 14, 16 are in their assembled state.

As best shown in FIG. 5, the base 66 illustratively forms the intake 24. The intake 24 illustratively includes an intake limb 86 and an intake passage 88 extending through the intake limb 86 to receive partially compressed fluid from the compressor 10. The intake passage 88 is illustratively formed as an intake nozzle. The intake passage 88 illustratively includes a reduced diameter section 90 disposed at one end 92, an increased diameter section 94 at an opposite end near the inlet 32, and a mid-section 95 extending between the reduced diameter section 90 and the increased diameter section 94 with a taper to transition between the sections 90, 94 as shown in FIG. 5. The intake passage 88 illustratively includes curvature, as shown in FIG. 5, which turns counter-clockwise proceeding from the reduced diameter section 90 to the increased diameter section 94 to generally align with the central axis 15 near the inlet 32.

Figure 7:
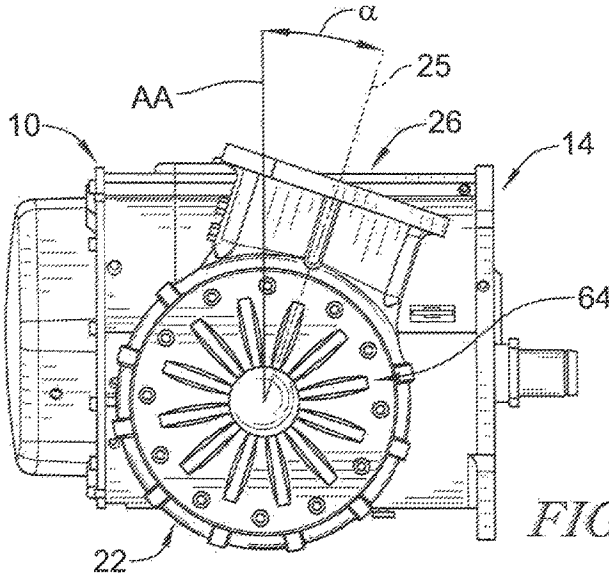
FIG. 7 is a side view of the first stage damper of FIGS. 1-6 showing that the second stage damper is secured to the compressor using the first alignment holes to have the first orientation relative to the vertical line AA (in the orientation as shown)
Figure 8:
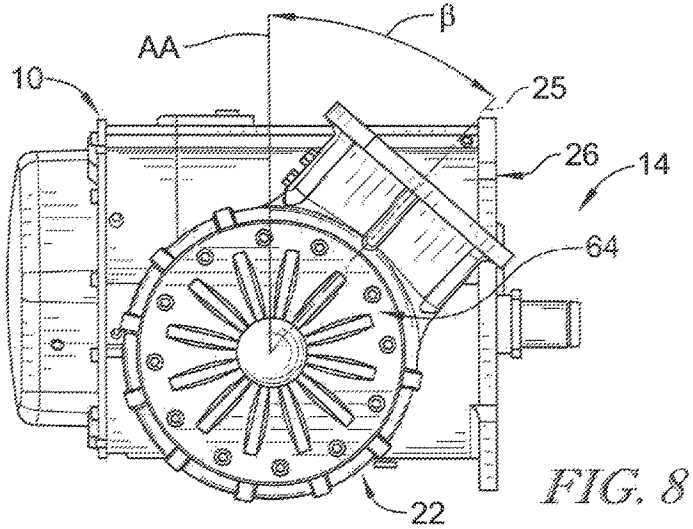
FIG. 8 is a side view of the first stage damper of FIGS. 1-7 showing that the second stage damper is secured to the compressor using the second alignment holes to have the second orientation relative to the vertical line AA (in the orientation as shown)
Figure 6:
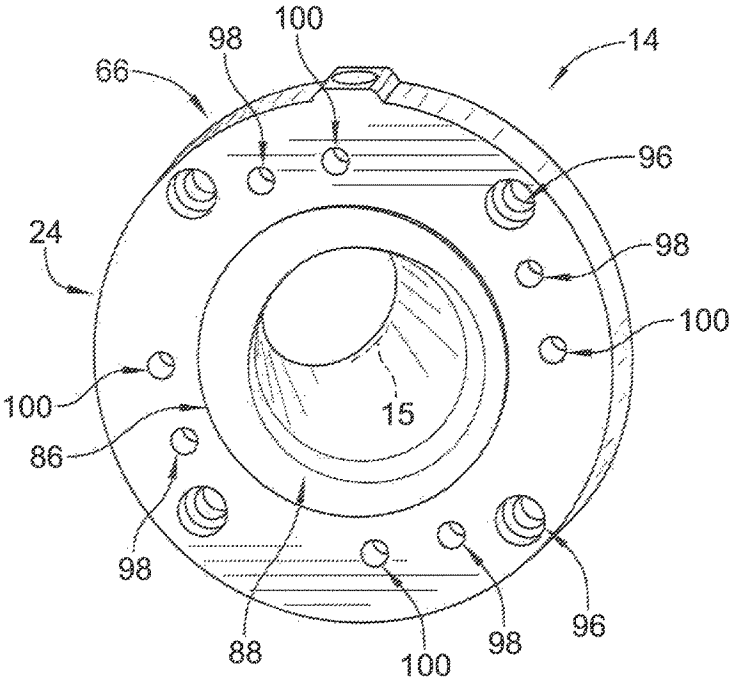
FIG. 6 is a bottom perspective view of the first stage damper FIGS. 1-5 showing that the base includes first alignment holes and second alignment holes for selectively receiving bolts to secure the base with the compressor, the first alignment holes are arranged to secure the base to the compressor in a first orientation and the second alignment holes are arranged to secure the base to the compressor in a second orientation.

As shown in FIG. 6, the base 66 of the housing 22 illustratively includes a number of mounting holes 96 extending therethrough to receive main fasteners for connecting the base 66 with the compressor 10. The base 66 illustratively includes attachment holes 98, 100 each arranged to correspond with one of the fasteners 82 for securing the base 66 with the body 62. Each attachment holes 98, 100 illustratively includes the inner threads that are complimentary with the outer threads of the fasteners 82 for receiving the fasteners 82 secured therein. By selectively securing the fasteners 82 within the attachment holes 98, the body 62 is secured to the base 66 with a first orientation (as shown in FIG. 7); alternatively, by securing the fasteners 82 within the attachment holes 100, the body is secure to the base 66 with a second orientation (as shown in FIG. 8). The body 62 can thus be selectively oriented relative to the base 66.

In the illustratively embodiment as shown in FIG. 7, the first orientation is shown. In the first orientation as shown in FIG. 7 the first stage damper 14 is arranged such that the discharge 26 has a high steepness for connection downstream. For example but without limitation, in the first orientation of the first stage damper 14, the compressor 10 is illustratively adapted for use as an air-cooled system in which an air-cooled intercooler cools the partially compressed air from the discharge 26 of the first stage damper 14. In some embodiments, in the first orientation of the first stage damper 14, the compressor 10 may be adapted for use with any suitable type of downstream connection, including but not limited to any suitable air/liquid/gas-cooled intercooler, treatment device, and/or transfer peripherals. In the first orientation, a center line 25 of the discharge 26 extends at an angle $\alpha$ from a vertical line AA (in the arrangement as shown in FIG. 7). In the illustrative embodiment, the angle is about 18 degrees, but in some embodiments, may be about 15 to about 20 degrees.

In the illustratively embodiment as shown in FIG. 8, the second orientation is shown. In the second orientation as shown in FIG. 8, the first stage damper 14 is arranged is arranged such that the discharge 26 has a moderate steepness for connection downstream. For example but without limitation, in the second orientation of the first stage damper 14, the compressor 10 is illustratively adapted for use as an liquid-cooled system in which a liquid-cooled intercooler cools the partially compressed air from the discharge 26 of the first stage damper 14. In some embodiments, in the second orientation of the first stage damper 14, the compressor 10 may be adapted for use with any suitable type of downstream connection, including but not limited to an suitable air/liquid/gas-cooled intercooler, treatment device, and/or transfer peripherals. In the second orientation the center line 25 of the discharge 26 extends at an angle $\beta$ from a vertical line AA (in the arrangement as shown in FIG. 8). In the illustrative embodiment, the angle is about 20 degrees, but in some embodiments, may be about 18 to about 25 degrees.

Figure 9:
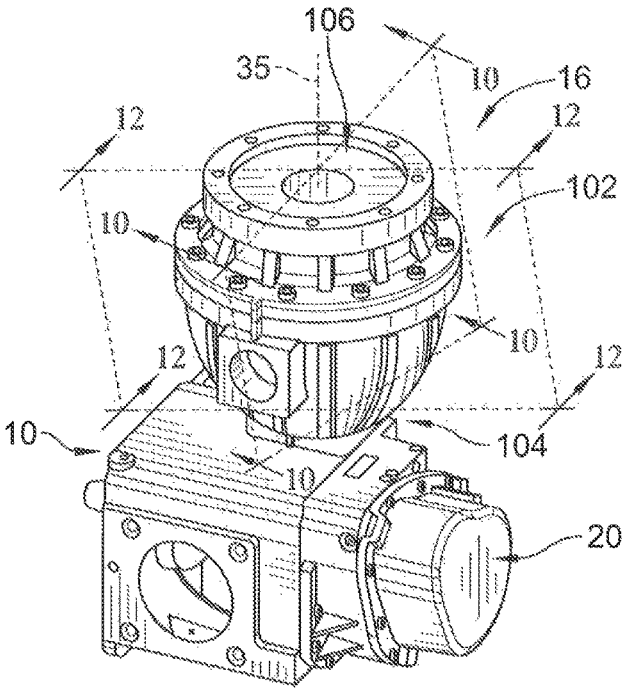
FIG. 9 is a closer perspective view of the second stage damper of the damper assembly of FIG. 1 showing that the second stage damper includes an intake (bottom) connected to the compressor to receive fully compressed gas and a discharge (shown disconnected) for discharging hilly compressed air having been dampened by the second stage damper.

In the illustrative embodiment as shown in FIG. 9, the second stage damper 16 illustratively includes a housing 102 that forms an intake 104 and a discharge 106. The intake 104 is illustratively connected to the compressor 10 to receive a flow of fully compressed fluid. The flow of hilly compressed fluid passes through the housing 102 for dampening and exits through the discharge 106. As mentioned above, the flow from the discharge 106 is illustratively distributed for use.

Figure 10:
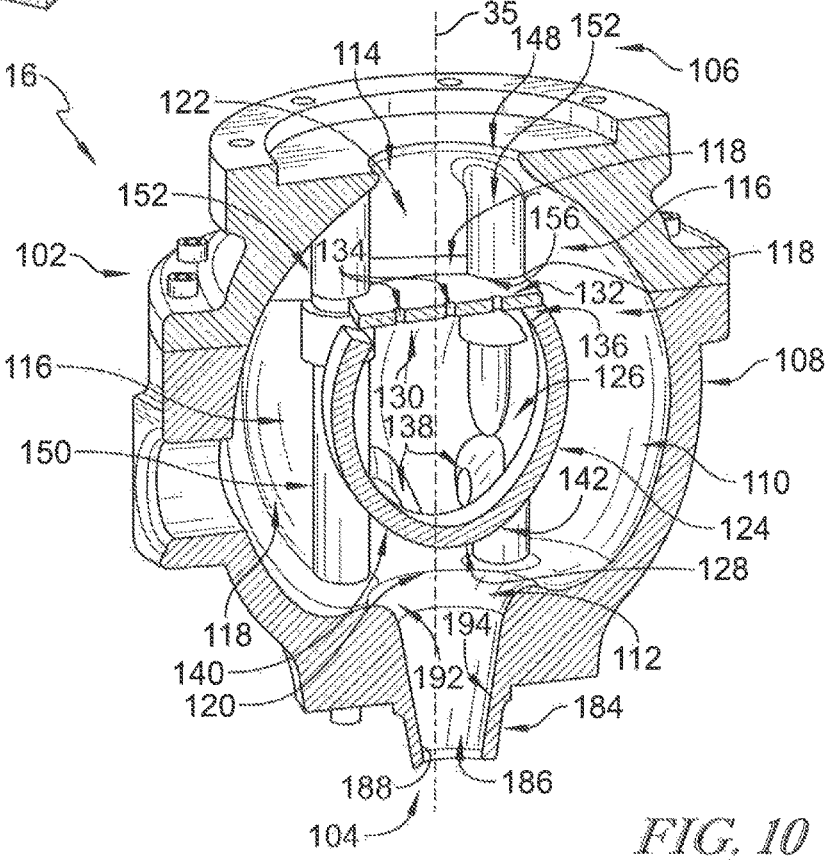
FIG. 10 is a cross-sectional view of the second stage damper of FIGS. 1 and 9 taken along the line 10-10 in FIG. 9 showing that the second stage damper includes an outer chamber, an inner chamber arranged within the outer chamber, and partitions that divide the outer chamber into sections that create parallel flow paths between the intake and the discharge, and showing that the damper includes a perforated damper plate arranged beyond an outlet of the inner chamber.

As shown in FIG. 10, the second stage damper 16 illustratively includes an outer chamber 108 formed at least partially by the housing 102. The outer chamber 108 illustratively includes an outer cavity 110 defined therein. In the illustrative embodiment, the outer chamber 108 and the outer cavity 110 are each generally spherical and are generally symmetrical about a central axis 35. The outer chamber 108 illustratively includes an inlet 112 and an outlet 114 each defined as openings of the outer chamber 108 that connect with the outer cavity 110. Partitions 38 (discussed below in more detail) illustratively divide the outer chamber 108 into sections 118. The sections 118 illustratively connect with each other at opposite ends to form manifolds 120, 122 which connect the outer chamber 108 with an inner chamber 124.

As shown in FIG. 10, the inner chamber 124 is illustratively arranged within the outer cavity 110 of the outer chamber 108. The inner chamber 124 illustratively includes an inner cavity 126 defined therein. In the illustrative embodiment, the inner chamber 124 and the inner cavity 126 are generally spherical and are generally symmetrical about the central axis 35. The inner chamber 124 illustratively includes an inlet 128 and an outlet 130 each embodied as openings of the inner chamber 124 that connect with inner cavity 126. In the illustrative embodiment, the inlet 128 and outlet 130 are arranged at opposite axial ends of the inner chamber 124 and connect with the manifolds 120, 122.

A damper plate 132 is illustratively arranged within the manifold 122 near the outlet 130 of the inner chamber 124 as shown in FIG. 10. The damper plate 132 illustratively includes perforations 134 extending therethrough parallel to the axis 35. In the illustrative embodiment, the damper plate 132 is arranged spaced apart from the inner chamber 124 to define a clearance 136 therebetween. Flow that passes through the inner chamber 124 and exits through the outlet 130 can either pass through the perforations 134 or the clearance 136 into the manifold 122.

As shown in FIG. 10, the inlet 128 of the inner chamber 124 illustratively connects with the manifold 120. The inlet 128 illustratively includes four openings 138 two of which are shown in the cross-sectional view of FIG. 10) extending through a wall 140 of the inner chamber 124. The wall 140 at the inlet 128 illustratively has a generally convex shape on an outer side 142 that faces the manifold 120 and the inlet 112 of the outer chamber 108 to guide at least a portion of the incoming flow from the inlet 112 towards the sections 118.

As shown in FIG. 10, the openings 138 of the inlet 128 illustratively penetrate through the wall 140 and connect the manifold 120 with the inner cavity 126. In the illustrative embodiment, the openings 138 are distributed evenly about the axis 35 and extend through the wall 140 in a direction that is generally parallel to the axis 35 and complimentary to the major direction of flow through the inlet 112 of the outer chamber 108. The inlet 128 of the inner chamber 124 illustratively forms a flow divider guiding a portion of flow through its openings 138 (and out through its outlet 130) and another portion of flow into the sections 118. The flow through the sections 118 illustratively forms an (outer) flow, and the flow through the inner cavity 126 illustratively forms another (inner) flow. The different portions of flow (outer and inner) illustratively pass through the second stage damper 16 in parallel with each other between the intake 104 and the discharge 106.

As shown in FIG. 10, the partitions 116 illustratively extend radially between the outer chamber 108 and the inner chamber 124 to define the sections 118 of the outer chamber 108. The partitions 116 illustratively extend axially through the outer cavity 110. In the illustrative embodiment, the partitions 116 are embodied as four walls distributed evenly about the axis 35. The partitions 116 illustratively provide structural support to the housing 102 and apportion the outer chamber 108 into the sections 118. The partitions 116 support the inner chamber 124 and separate the flow into different sections 118. In some embodiments, the partitions 116 may include any number of walls and/or maybe arranged within uneven distribution about the axis 35. The sections 118 illustratively form distinct flow paths arranged in parallel with each other and connecting with each other to form the manifolds 120, 122. The inner chamber 124, in combination with the damper plate 52, illustratively dissipate pressure pulsations from the compressor 10. The distinct flow paths provided by the sections 118 illustratively assist in reducing pressure pulsations within the total flow from the compressor 10.

Figure 11:
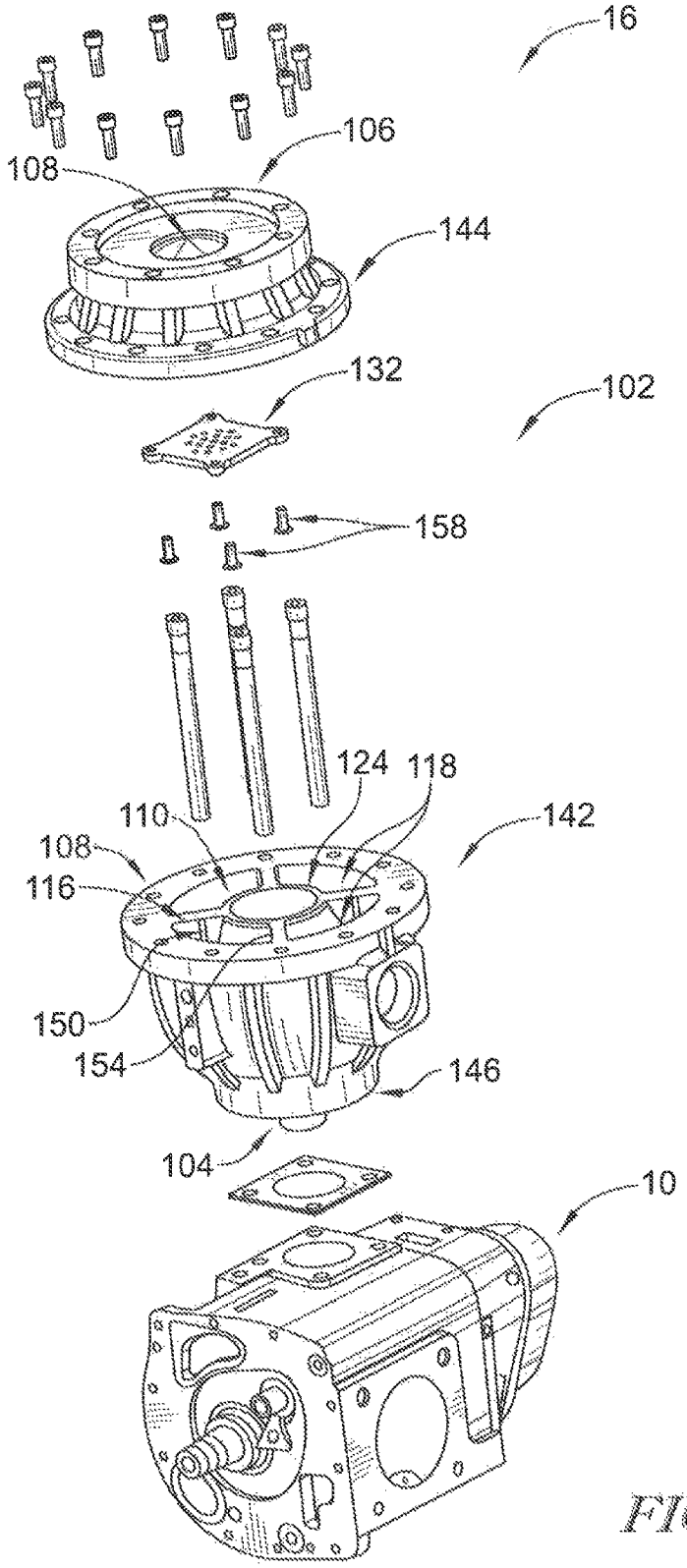
FIG. 11 is an exploded perspective view of the second stage damper of FIGS. 1, 9, and 10 showing that the second stage damper includes a housing that forms a portion of the outer chamber, the housing includes a body, a cap, and a base formed integrally with the body.

As shown in FIG. 11, the housing 102 illustratively includes a body 142 and a cap 144 that collectively compose the outer chamber 28. In the illustrative embodiment, unlike the housing 22 of the first stage damper 14 which has a base 66 separated from the body 62, the body 142 of the second stage damper 16 forms a base 146 integrally therewith, in some embodiments, the base 146 make be distinct from the body 142. The cap 144 illustratively attaches to the body 142 on an opposite end from the base 146 to enclose the outer chamber 108. The discharge 106 illustratively includes a discharge passage 148 extending through the cap 144 and connecting with the outlet 114 of the outer chamber 28. The discharge passage 148 is illustratively connected with the manifold 122 through the outlet 114. In the illustrative embodiment, unlike the discharge passage 69 of the first stage damper 14, the outlet 114 is not positioned with any single section 118. The discharge passage 148 illustratively communicates with each section 118 through the manifold 122.

As shown in FIGS. 10 and 11, the partitions 116 each include a base portion 150 and a head portion 152 (best shown in FIG. 10). Each base portion 150 illustratively extends radially between the outer chamber 108 and the inner chamber 124 and includes an axial end 154 arranged near the manifold 122. In the illustrative embodiment, each base portion 150 is illustratively formed integrally with each of the outer and inner chambers 108, 124, but in some embodiments, may be formed separately or integrally with only one of the chambers 108, 124. Each head portion 152 illustratively extends from the cap 144 into the outer chamber 108 to an inner end 156 opposite the axial end 154 of the base portion 150.

As shown in FIG. 10, the damper plate 132 is illustratively arranged between the base portion 150 and the head portion 152 of each partition 116 to define the clearance 136 with the inner chamber 124. The damper plate 132 is illustratively attached to each head portion 152 by fasteners 158 that extend through the damper plate 132 and connect with the respective head portions 152. In the illustrative embodiment, the fasteners 158 are bolts having outer threads for engagement with complimentary inner threads of the head portions 152.

Figure 12:
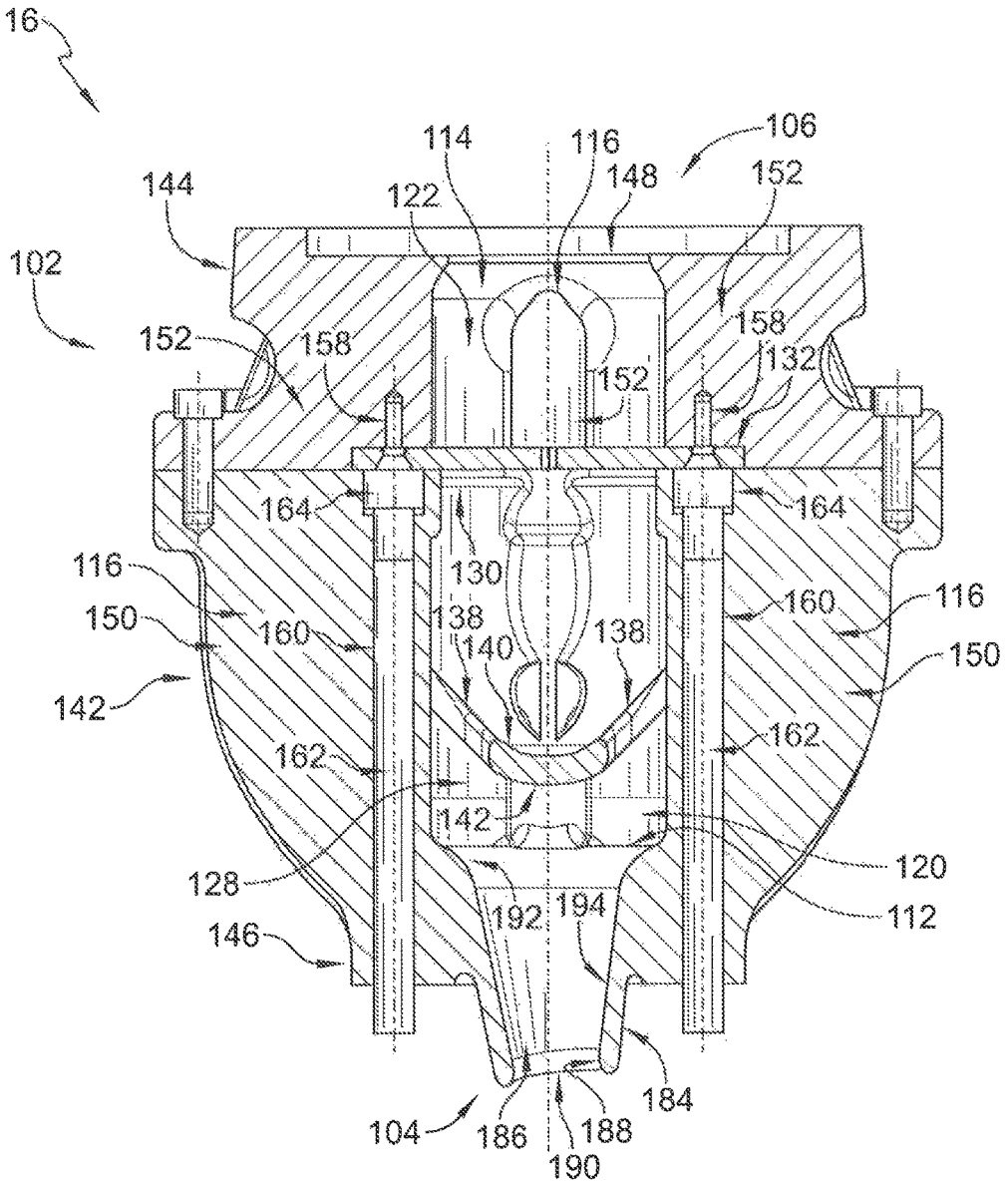
FIG. 12 is a cross-sectional view of the second stage damper of FIGS. 1 and 9-11, taken along the line 12-12 in FIG. 9 showing that the partitions extend between the outer chamber and the inner chamber and include holes for receiving long bolts which are prevented from being removed from their holes by the cap.

As shown in FIG. 12, the base portion 150 of each partition 116 illustratively includes a fastener hole 160 extending therethrough from the axial end 154 through the base 146. The fastener holes 160 are illustratively arranged to receive fasteners 162 therethrough to connect with the compressor 10 for securing the second stage damper 16 thereto. Each fastener 162 illustratively includes a head 164 that is recessed within a larger portion of the fastener hole 160. In the illustrative embodiment, the fasteners 162 are bolts having external threads for engagement with complimentary internal threads of the compressor 10.

As shown in FIG. 12, the fasteners 158, 162 are illustratively prevented from removal from their secured positions by the arrangement of the base and head portions 150, 152 of the partitions 116 and/or the inner chamber 124. As shown in FIG. 12, the head portion 152 of the partitions 116 is arranged in close proximity to the fasteners 162 and their fastener holes 160 and if any fastener 162 (or any portion thereof, for example, broken fragment) began to exit its fastener hole 180 within the base portion 150, the fastener 162 would contact the respective head portion 152 and be prevented from entering into the flow paths within the second stage damper 16 (and downstream). As shown in FIG. 12, the base portion 150 of each partition 116 and/or the inner chamber 124 are arranged in close proximity to the fasteners 158 and if any fastener 158 began to exit from connection with the head portion 152, the fastener 158 would contact the respective base portion 150 and/or the inner chamber 124 and be prevented from entering into the flow paths within the second stage damper 16 (and downstream). Such interference arrangement of the fasteners 158, 182 can prevent accidental entrainment of fasteners into the flow paths of the dampers 14, 16 (and into the compressor 10) while the dampers 14, 16 are in their assembled state.

As best shown in FIG. 12, the base 146 illustratively forms the intake 104. The intake 104 illustratively includes an intake limb 184 and an intake passage 186 extending through the intake limb 184 to receive partially compressed fluid from the compressor 10. The intake passage 186 is illustratively formed as an intake nozzle. The intake passage 186 illustratively includes a reduced diameter section 188 disposed at one end 190, an increased diameter section 192 at an opposite end near the inlet 112, and a mid-section 194 extending between the reduced diameter section 188 and the increased diameter section 192 with a taper to transition between the sections 188, 190. In the illustrative embodiment as shown in FIG. 12, unlike the intake passage 88 of the first stage damper 14, the intake passage 186 is straight (though with taper) and generally aligns with the central axis 35 proceeding from the reduced diameter section 188 to the increased diameter section 192.

The present disclosure includes portions of flow through sections of outer chambers and portions of flow through inner chambers running in parallel with each other. Some of these parallel flows can be directed through a perforated damper plate. The parallel flows can increase dampening performance. According to the present disclosure, the pulsations and/or other incidental forces and/or effects of displacement-type compressors can be controlled and/or reduced effectively.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A damper for reducing pulsation from a compressor, the damper comprising:

an outer chamber defining an outer cavity therein, the outer chamber being arranged to pass flow from an inlet to an outlet thereof, an inner chamber arranged within the outer cavity and defining an inner cavity therein, the inner chamber being arranged to pass flow from an inlet to an outlet thereof, and a number of partitions dividing the outer cavity of the outer chamber into sections, the number of partitions each extending between the outer chamber and the inner chamber, wherein at least some of the sections are connected with each other near the inlet of the inner chamber to form an inlet manifold and are connected with each other near the outlet of the inner chamber to form an outlet manifold and each extend between the respective inlet and outlet manifolds to define flow paths between the inlet and the outlet of the outer chamber, wherein a housing forms at least a portion of the outer chamber, the housing including a body and a cap removably fastened to the body, the body and cap interfacing with each other along the outlet of the inner chamber.

2. The damper of claim 1, wherein the inlet of the inner chamber is connected with the inlet manifold and the outlet of the inner chamber is connected with the outlet manifold.

3. The damper of claim 1, wherein the housing defines at least a portion of the outer cavity.

4. The damper of claim 3, wherein the body foil is a base portion of the outer chamber and forms the inner chamber.

5. The damper of claim 4, wherein the cap forms a head portion of the outer chamber.

6. The damper of claim 3, wherein the body forms a base portion of each of the number of partitions.

7. The damper of claim 6, wherein the cap forms a head portion of each of the number of partitions.

8. The damper of claim 7, wherein each base portion includes a fastener hole defined therethrough for receiving a fastener to secure the body with the compressor.

9. The damper of claim 8, wherein the head portion of each of the number of partitions is arranged to prevent removal of the fastener from the fastener hole of the corresponding base portion.

10. The damper of claim 7, further comprising a damper plate arranged between the base portion and the head portion of each of the number of partitions.

11. The damper of claim 10, wherein the damper plate is a perforated plate arranged to span across the outlet of the inner chamber to receive at least a portion of flow therethrough.

12. The damper of claim 10, wherein the damper plate is attached to the head portion of the number of partitions with at least one fastener and at least one of the inner chamber and the base portions of the number of partitions are arranged to prevent removal of the at least one fastener when the cap is fastened to the body.

13. The damper of claim 12, wherein the at least one of the inner chamber and the base portions of the number of partitions are arranged in close proximity to the at least one fastener to interrupt extraction by contact with a head of the at least one fastener to prevent removal when the cap is fastened to the body by arrangement.

14. A damper for reducing pulsation from a compressor, the damper comprising:

an outer chamber defining an outer cavity therein, the outer chamber being arranged to pass flow from an inlet to an outlet thereof, an inner chamber arranged within the outer cavity and defining an inner cavity therein, the inner chamber being arranged to pass flow from an inlet to an outlet thereof, and a number of partitions dividing the outer cavity of the outer chamber into sections that are each connected with the inlet and outlet of the outer chamber to form parallel flow paths, wherein the inlet of the inner chamber comprises a number of inlet openings defined through an inlet wall of the inner chamber, wherein a first flow passage is defined from the inlet of the outer chamber, through at least one of the sections, to the outlet of the outer chamber; and a second flow passage is defined from the inlet of the inner chamber, through the inner chamber, through the outlet of the inner chamber; and wherein the first flow passage and the second flow passage are arranged in parallel with each other, wherein a housing forms at least a portion of the outer chamber, the housing including a body and a cap removably fastened to the body, wherein the body and cap interface with each other along the outlet of the inner chamber.

15. The damper of claim 14, wherein the inlet wall has a conical shape that is convex on an outer side thereof to guide at least some flow through the sections.

16. The damper of claim 14, further comprising a perforated plate arranged near the outlet of the inner chamber, wherein the second flow passage is further defined through the perforated plate.

17. A damper for reducing pulsation from a compressor, the damper comprising:

an outer chamber defining an outer cavity therein, the outer chamber being arranged to pass flow from an inlet to an outlet thereof, an inner chamber arranged within the outer cavity and defining an inner cavity therein, the inner chamber being arranged to pass flow from an inlet to an outlet thereof, and a number of partitions dividing the outer cavity of the outer chamber into sections that are each connected with the inlet and outlet of the outer chamber to form parallel flow paths, wherein a housing forms at least a portion of the outer chamber, the housing includes a body and a cap removably attached to the body to define at least a portion of the outer cavity, the body and cap interfacing with each other along the outlet of the inner chamber.

18. The damper of claim 17, wherein the housing further includes a base having an intake passage defined therethrough, the intake passage being connected with the inlet of the outer chamber to receive flow from the compressor.

19. The damper of claim 18, wherein the intake passage forms an intake nozzle.

20. The damper of claim 18, wherein the base is integrally formed with the body.

21. The damper of claim 17, wherein the sections are connected to each other to form an outlet manifold and the outlet of the outer chamber is arranged within only one of the sections.

22. The damper of claim 21, wherein the housing includes a discharge limb extending from the outer chamber and defining a discharge passage that extends from the outlet of the outer chamber through the discharge limb to expel flow.

23. A damper system for reducing pulsation from a compressor, the damper system comprising:

a first stage damper, and a second stage damper, the first and second stage dampers each comprising:

an outer chamber defining an outer cavity therein, the outer chamber being arranged to pass flow from an inlet to an outlet thereof, an inner chamber arranged within the outer cavity and defining an inner cavity therein, the inner chamber being arranged to pass flow from an inlet to an outlet thereof, wherein at least one of the first and second stage dampers include a number of partitions dividing the respective outer cavity of the outer chamber into sections that are each connected with the inlet and the outlet of the outer chamber to form flow paths, and at least one of the first and second stage dampers include a housing including a body and a cap removably attached to the body to define at least a portion of the outer cavity, the body and cap interfacing with each other along the outlet of the inner chamber.

24. The damper system of claim 23, wherein the first stage damper is attached to the compressor to receive partially compressed air, pass the partially compressed air from the inlet to the outlet of the outlet chamber thereof, and to discharge the partially compressed into the compressor for further compression, and wherein the second stage damper is attached to the compressor to receive fully compressed air, pass the fully compressed air from the inlet to the outlet of the outlet chamber thereof, and to discharge the fully compressed air for use.

* * * * *